US008307573B2

(12) United States Patent
Wagger et al.

(10) Patent No.: US 8,307,573 B2
(45) Date of Patent: Nov. 13, 2012

(54) ROTARY SNOW TILLER FOR GROOMING SKI SLOPES

(75) Inventors: Klaus Wagger, Brunico (IT); Jan Müller, Vipiteno (IT)

(73) Assignee: Rolic Invest S.A.R.L., Luxembourg (LU)

( * ) Notice: Subject to any disclaimer, the term of this patent is extended or adjusted under 35 U.S.C. 154(b) by 181 days.

(21) Appl. No.: 12/740,935

(22) PCT Filed: Oct. 29, 2008

(86) PCT No.: PCT/EP2008/064695

§ 371 (c)(1),
(2), (4) Date: Aug. 13, 2010

(87) PCT Pub. No.: WO2009/056579

PCT Pub. Date: May 7, 2009

(65) Prior Publication Data

US 2010/0307033 A1 Dec. 9, 2010

(30) Foreign Application Priority Data

Oct. 31, 2007 (IT) ..... MI2007A2105

(51) Int. Cl.
*E01H 5/04* (2006.01)

(52) U.S. Cl. ..... 37/223

(58) Field of Classification Search ..... 37/196, 37/209, 219–223, 348; 172/68–72
See application file for complete search history.

(56) References Cited

U.S. PATENT DOCUMENTS 3,170,533 A 2/1965 Fewel et al.
3,227,295 A 1/1966 Hamilton et al.
3,386,778 A 6/1968 Rymes
3,534,701 A 10/1970 Hebert
3,692,132 A 9/1972 Pollanen
3,763,944 A 10/1973 Kaltenegger
4,087,135 A 5/1978 Unruh
4,348,825 A 9/1982 Bachler
4,458,954 A 7/1984 Haas
4,458,955 A 7/1984 Webb
4,500,139 A 2/1985 Tucek
4,788,783 A 12/1988 Bachler
5,062,493 A 11/1991 Platter et al.
5,067,263 A 11/1991 Pelletier (Continued)

FOREIGN PATENT DOCUMENTS

CA 2211050 1/1998

(Continued)

OTHER PUBLICATIONS

PistenBully 600 brochure, written by Kassbohrer Gelandefahrzeug AG, published in Mar. 2010.

(Continued)

*Primary Examiner* — Robert Pezzuto
(74) *Attorney, Agent, or Firm* — Neal, Gerber & Eisenberg LLP

(57) ABSTRACT

A rotary snow tiller for grooming the snow covering of ski slopes, and which advances in a traveling direction along the ski slope, and has a frame; and a shaft which is rotated with respect to the frame about a first axis crosswise to the traveling direction, and is fitted with tools, each of which extends along a second axis crosswise to the first axis, and is selectively adjustable about the second axis with respect to the first axis.

17 Claims, 4 Drawing Sheets

U.S. PATENT DOCUMENTS

| | | | | |
|---|---|---|---|---|
| 5,809,671 | A * | 9/1998 | Sinykin | 37/219 |
| 6,155,363 | A | 12/2000 | Matsumoto et al. | |
| 6,296,330 | B1 | 10/2001 | Hall | |
| 6,354,023 | B1 | 3/2002 | Trahan et al. | |
| 6,418,645 | B1 | 7/2002 | Hammerle et al. | |
| 6,637,134 | B2 | 10/2003 | Hammerle | |
| 6,810,609 | B2 | 11/2004 | Lassonde et al. | |
| 6,921,304 | B2 | 7/2005 | Hewitt | |
| 6,983,927 | B2 | 1/2006 | Pelletier et al. | |
| 7,464,699 | B2 | 12/2008 | Joppig et al. | |
| 7,530,547 | B2 | 5/2009 | Leitner et al. | |
| 2002/0139013 | A1 | 10/2002 | Hammerle | |
| 2003/0051376 | A1 | 3/2003 | Lassonde et al. | |
| 2003/0159840 | A1 | 8/2003 | Schmidt, Jr. | |
| 2004/0069981 | A1 | 4/2004 | Pelletier et al. | |
| 2005/0252592 | A1 | 11/2005 | Albright et al. | |
| 2005/0279980 | A1 | 12/2005 | Leitner et al. | |
| 2007/0130806 | A1 | 6/2007 | Goodman | |
| 2008/0257616 | A1 | 10/2008 | Olsson | |
| 2008/0269986 | A1 | 10/2008 | Regnell et al. | |
| 2008/0309157 | A1 | 12/2008 | Runggaldier et al. | |
| 2009/0000833 | A1 | 1/2009 | Dorais et al. | |
| 2009/0007461 | A1 | 1/2009 | Pelletier et al. | |
| 2009/0013562 | A1 | 1/2009 | Pelletier | |

FOREIGN PATENT DOCUMENTS

| | | | |
|---|---|---|---|
| CA | 2443765 | A1 | 4/2004 |
| DE | 2145772 | | 3/1973 |
| DE | 2148304 | | 4/1973 |
| DE | 2219623 | | 11/1973 |
| DE | 2254276 | | 5/1974 |
| DE | 3440491 | | 5/1986 |
| DE | 3534626 | | 3/1987 |
| DE | 29515866 | | 1/1996 |
| DE | 29603251 | | 4/1996 |
| DE | 10320523 | | 11/2004 |
| EP | 0551160 | A1 | 7/1993 |
| EP | 1405782 | | 4/2004 |
| EP | 1674382 | A1 | 10/2005 |
| EP | 1591350 | A2 | 11/2005 |
| EP | 1827954 | B1 | 12/2005 |
| EP | 1995159 | A1 | 6/2007 |
| EP | 1872683 | A1 | 1/2008 |
| EP | 1908673 | B1 | 9/2009 |
| EP | 1908672 | B1 | 4/2010 |
| FR | 2336292 | | 7/1977 |
| FR | 2536437 | | 5/1984 |
| FR | 2586727 | | 3/1987 |
| GB | 1590358 | | 6/1981 |
| JP | 01144287 | | 10/1989 |
| JP | 03182887 | | 8/1991 |
| JP | 7237566 | | 9/1995 |
| WO | WO 2005093173 | | 10/2005 |
| WO | WO2006069671 | | 7/2006 |
| WO | WO2006069682 | | 7/2006 |
| WO | WO2008114138 | | 9/2008 |
| WO | WO2008155423 | | 12/2008 |
| WO | WO2008155425 | | 12/2008 |
| WO | WO2009034183 | | 3/2009 |
| WO | WO2009034185 | | 3/2009 |
| WO | WO2009056576 | | 5/2009 |
| WO | WO2009056577 | | 5/2009 |
| WO | WO2009056578 | | 5/2009 |

OTHER PUBLICATIONS

PistenBully Scout brochure, written by Kassbohrer Gelandefahrzeug AG, published in Jan. 2010.

* cited by examiner

ROTARY SNOW TILLER FOR GROOMING SKI SLOPES

PRIORITY CLAIM

This application is a national stage application of PCT/EP2008/064695, filed on Oct. 29, 2008, which claims the benefit of and priority to Italian Patent Application No. MI2007A 002105, filed on Oct. 31, 2007, the entire contents of which are incorporated herein.

TECHNICAL FIELD

The present disclosure relates to a rotary snow tiller for grooming ski slopes.

BACKGROUND

Known rotary snow tillers for grooming ski slopes normally advance in a traveling direction along the ski slope, and comprise a frame; and a shaft which is rotated with respect to the frame about a first axis crosswise to the traveling direction, and is fitted with tools, each extending along a second axis crosswise to the first.

Such known rotary snow tillers have proved particularly effective in grooming ski slopes. The snow covering, however, varies considerably with weather conditions, snowfall and, particularly, daily variations in temperature, and since these known rotary snow tillers are equipped with standard-configuration tools that fail to adapt to different snow covering conditions, it is not always possible to achieve a perfectly groomed snow covering.

More specifically, each tool comprises a cutter inclined at a given angle to the shaft to cut into and simultaneously lift part of the snow covering to recirculate part of the snow into the casing over the shaft. Alongside variations in external conditions, the snow covering may be formed of soft snow, icy snow, and slush, so, depending on the type of snow covering, it is necessary to promote a cutting action of the tools to cut into the snow covering, or a paddle action to lift and recirculate the snow. Privileging the cutting action is also important when working with icy snow to avoid excess energy consumption. Such known rotary snow tillers, however, fail to adapt to different types of snow covering, on account of the tools being welded to the shaft.

SUMMARY

It is an object of the present disclosure to provide a rotary snow tiller for grooming ski slopes, configured to eliminate certain of the drawbacks of the above-described known rotary snow tillers in a straightforward, low-cost manner, and in particular to adapt to different types of snow covering.

According to the present disclosure, there is provided a rotary snow tiller for grooming the snow covering of ski slopes, and which advances in a traveling direction along the ski slope; the rotary snow tiller comprising a frame; and a shaft which is rotated with respect to the frame about a first axis crosswise to the traveling direction, and is fitted with tools, each extending along a second axis crosswise to the first axis; the rotary snow tiller being characterized in that the tools are selectively adjustable about the second axis with respect to the first axis.

Additional features and advantages are described in, and will be apparent from, the following Detailed Description and the figures.

BRIEF DESCRIPTION OF THE DRAWINGS

A non-limiting embodiment of the present disclosure will be described by way of example with reference to the accompanying drawings, in which.

DETAILED DESCRIPTION

Figure 1:
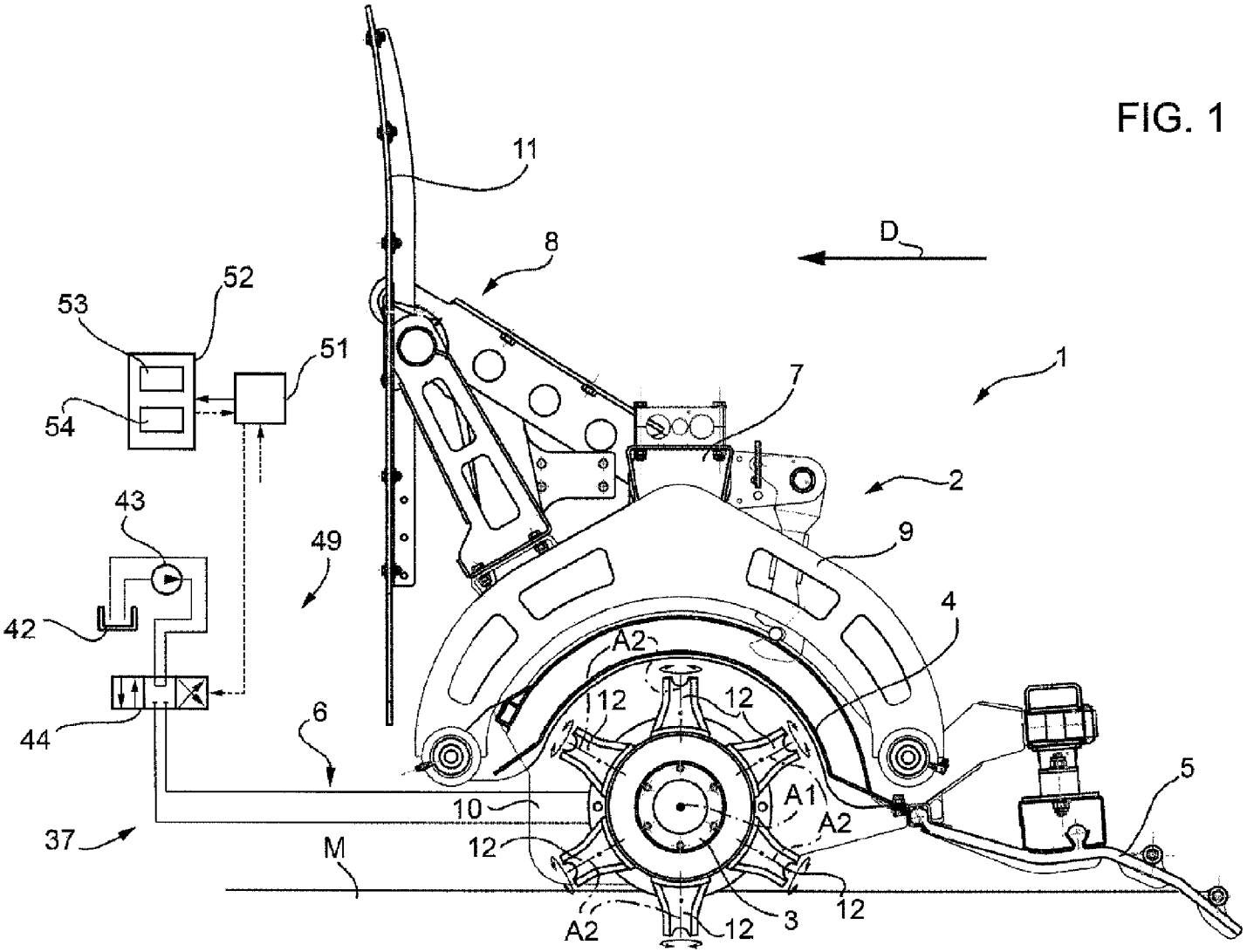
FIG. 1 shows a side view, with parts removed for clarity, of a rotary snow tiller for grooming ski slopes, in accordance with the present disclosure.

Referring now to the example embodiments of the present disclosure illustrated in FIGS. 1 to 6, number 1 in FIG. 1 indicates as a whole a rotary snow tiller for grooming the snow covering M of ski slopes, and which is towed in a traveling direction D by a snow groomer vehicle not shown in the drawings.

Rotary snow tiller 1 is configured to till a surface layer of snow covering M, and comprises a frame 2; a shaft 3 rotated with respect to frame 2 about an axis A1 crosswise to traveling direction D; a protective casing 4 surrounding shaft 3; a flexible finish mat 5 which is connected to casing 4, extends behind shaft 3, and is drawn over the surface of the tilled snow covering M; and an actuating device 6 associated with and for altering the configuration of shaft 3.

Frame 2 comprises a bar 7 parallel to axis A1; a hitch device 8 fixed to bar 7 and for connecting tiller 1 to the snow groomer vehicle (not shown); two arc-shaped segments 9 (only one shown) fixed transversely to bar 7; and two plates 10 (only one shown in FIG. 1) for supporting shaft 3.

Rotary snow tiller 1 comprises two adjustable panels 11 (only one shown in FIG. 1) which act to a certain extent as splash guards to protect casing 4 and finish mat 5 from the snow thrown up by the groomer vehicle not shown in the drawings.

Shaft 3 comprises a number of tools 12 equally spaced about and along axis A1, and each of which extends along a substantially radial axis A2, is configured to penetrate snow covering M, and rotates about axis A2.

The length of shaft 3 defines the work range and the width of tiller 1 as a whole.

Figure 6:
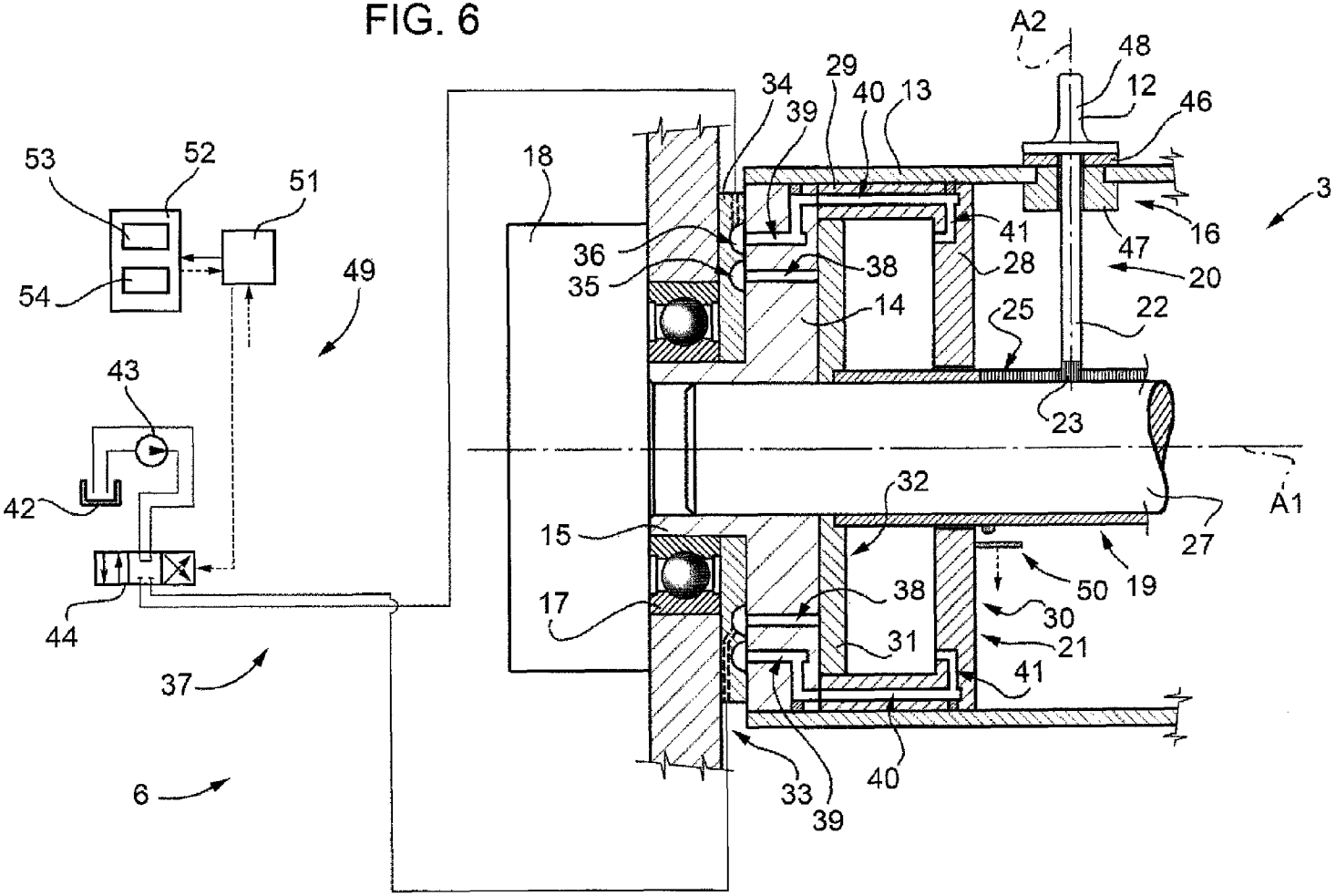
FIG. 6 shows a schematic longitudinal section, with parts in section and parts removed for clarity, of a detail of the FIG. 1 rotary snow tiller.

With reference to FIG. 6, shaft 3 comprises a hollow cylinder 13; two end flanges 14 (only one shown in FIG. 6) fitted to opposite ends of hollow cylinder 13; two sleeves 15 (only one shown in FIG. 6) integral with respective flanges 14; and seats 16 (only one shown in FIG. 6) equally spaced along hollow cylinder 13 to house respective tools 12. Each sleeve 15 is supported by a plate 10 of frame 2 by a respective bearing 17. One of sleeves 15 is connected to a rotary actuator 18, such as a hydraulic motor, for rotating shaft 3 about axis A1 to till the snow covering.

Actuating device 6 comprises a cylindrical actuating member 19 extending inside hollow cylinder 13 and rotating about axis A1 integrally with hollow cylinder 13 and sleeves 15; a number of connecting mechanisms or connectors 20 (only one shown in FIG. 6), each connecting a respective tool 12 to actuating member 19; and a hydraulic linear actuator 21 for translating actuating member 19 along axis A1 with respect to hollow cylinder 13.

Figure 2:
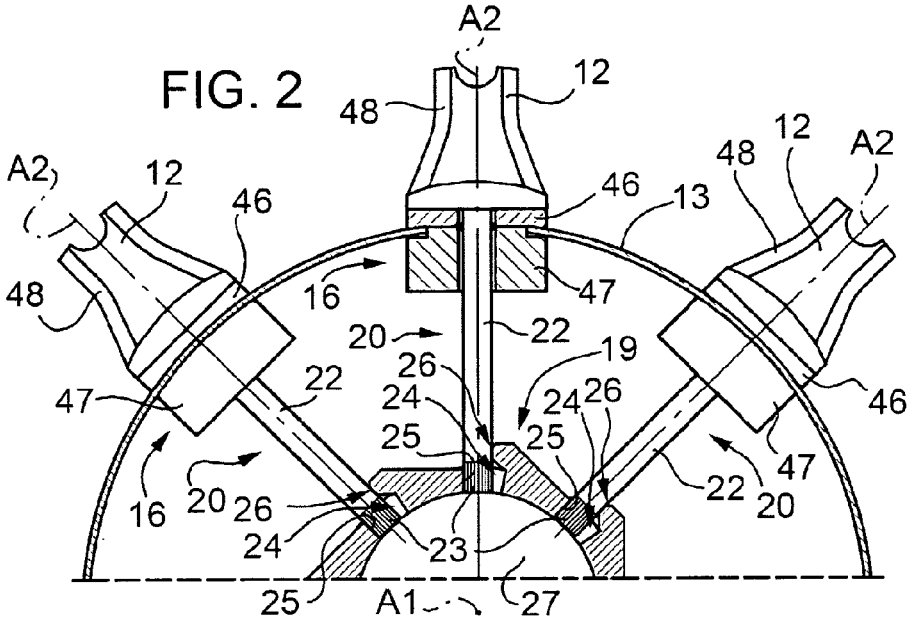
FIGS. 2 and 3 show larger-scale cross sections, with parts removed for clarity, of a detail of the FIG. 1 rotary snow tiller in two operating positions.
Figure 3:
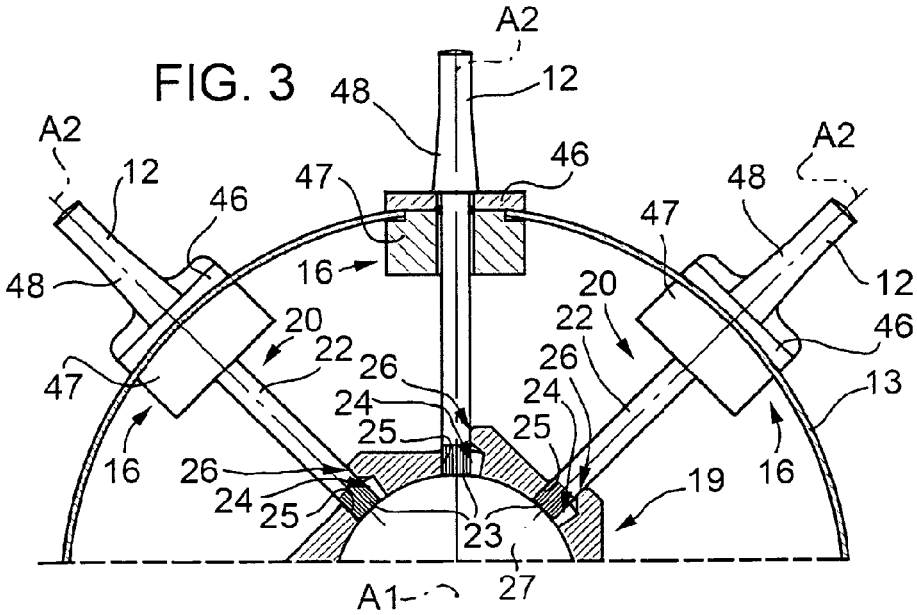
Figure 4:
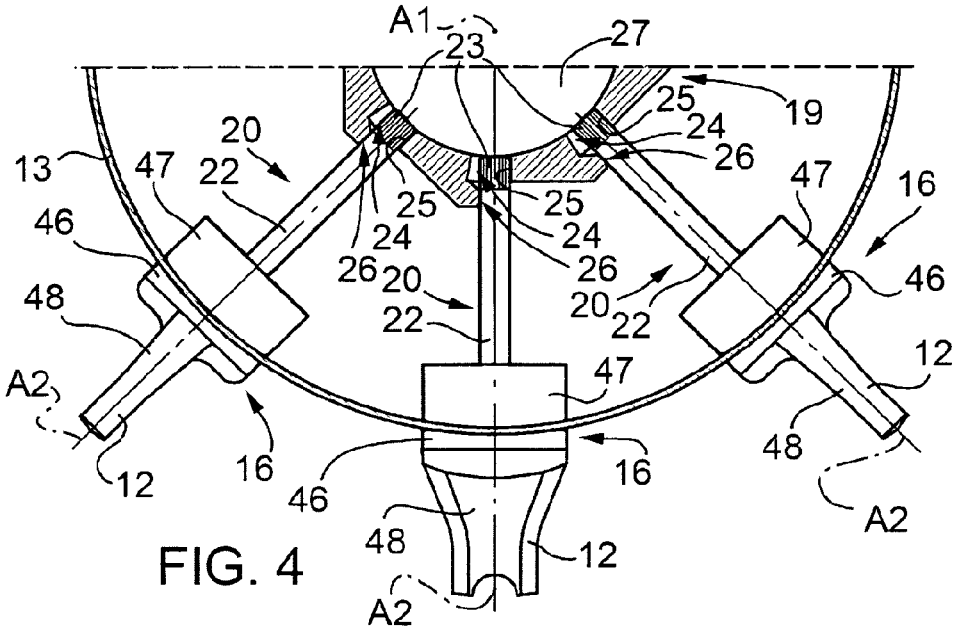
FIGS. 4 and 5 show larger-scale cross sections, with parts removed for clarity, of a detail of the FIG. 1 rotary snow tiller in two operating positions and in accordance with a variation of the present disclosure.

In FIGS. 2 to 4, connecting mechanism or connectors 20 comprises a pin 22 integral with a respective tool 12 and connected to actuating member 19. Pin 22 has one end 23 with axial teeth (with reference to axis A2); and actuating member 19 has a number of grooves 24, each parallel to axis A1 and bounded by two faces 25, 26 parallel to axis A1. Face 25 is toothed and engages end 23 so that axial translation of actuating member 19 rotates tool 12. Face 26 is flat and acts as a support for pin 22.

With reference to FIG. 6, shaft 3 comprises an auxiliary shaft 27 which extends along axis A1, connects the two sleeves 15, is integral with hollow shaft 13, and acts as a support for actuating member 19, which slides on auxiliary shaft 27.

Linear actuator 21 comprises one of end flanges 14; a disk 28; a spacer ring 29 defining an annular cylinder 30 about auxiliary shaft 27; and a disk 31 integral with actuating member 19 and defining a piston 32 that slides axially inside annular cylinder 30. Linear actuator 21 is supplied by a rotary distributor 33 which, in the example shown, comprises an annular disk 34 integral with plate 10 of frame 2 and fitted in sliding manner to end flange 14. Annular disk 34 comprises two annular grooves 35, 36 facing end flange 14 and communicating with a hydraulic circuit 37 which is an integral part of actuating device 6. End flange 14 has holes 38 facing annular groove 35 and terminating directly inside annular cylinder 30; and holes 39 facing annular groove 36 and which, together with holes 40 and 41 formed in spacer ring 29 and disk 28 respectively, form channels terminating inside annular cylinder 30, on the opposite side to holes 38. Linear actuator 21 is thus substantially a double-acting hydraulic cylinder. And disk 31 is therefore translated along axis A1 in one direction or the other, depending on which of annular grooves 35, 36 is supplied.

Hydraulic circuit 37 comprises a tank 42, a pump 43, and a solenoid valve 44, and provides for selectively supplying groove 35 and draining groove 36, supplying groove 36 and draining groove 35, or cutting off supply to and from grooves 35, 36, so that actuating member 19 is respectively translated in one axial direction, translated in the opposite direction with respect to hollow cylinder 13, or locked in a given position, and the orientation of tools 12 is thus altered by connecting mechanisms or connectors 20.

With reference to FIGS. 2 and 3, each tool 12 comprises a cylindrical portion 45 housed inside a respective seat 16 formed substantially by an outer bush 46 connected to an inner bush 47. Each tool 12 comprises a cutter 48 which, in FIG. 2, is positioned crosswise to axis A1 to privilege the cutting action, and, in FIG. 3, is rotated 90° with respect to the FIG. 2 position and is parallel to axis A1 to privilege the paddle action and recirculate snow into casing 4 (FIG. 1).

In FIGS. 2 and 3, cutters 48 of tools 12 are all oriented the same way, (i.e., are perpendicular to axis A1 in FIG. 2 and parallel to axis A1 in FIG. 3). The positions shown in FIGS. 2 and 3 are extreme positions, and cutters 48 are actually oriented about axis A2 to form an angle ranging between the extreme positions shown and depending on snow covering M. When cutters 48 are tilted at angles other than those shown in FIGS. 2 and 3, shaft 3, as it tills snow covering M, produces a build-up of snow on one side, due to the equioriented tools 12 between casing 4 (FIG. 1) and snow covering M forming a screw that accumulates the tilled snow along one side of rotary snow tiller 1.

In some situations, this is desirable, and, in others, to be avoided.

Figure 5:
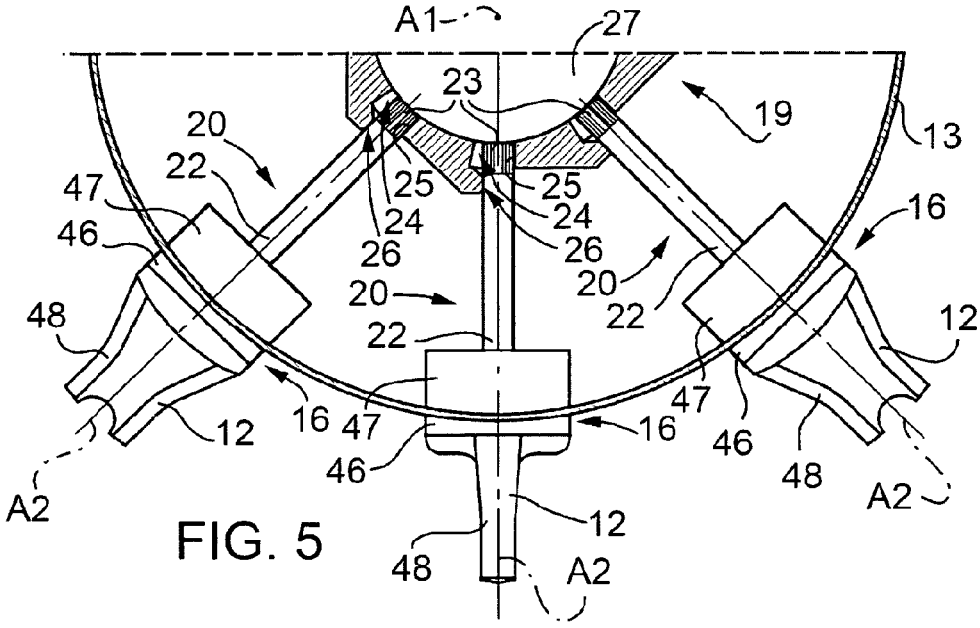

In the embodiment illustrated in FIGS. 4 and 5, tools 12 are divided into two groups: cutters 48 of tools 12 in one group have a given orientation, whereas cutters 48 of tools 12 in the other group are offset 90° with respect to cutters 48 of tools 12 in the first group. The difference in the orientation of cutters 48 may be of any angle between 0° and 90°. The tools 12 in the first and second group alternate both along and about axis A1, and this setup of tools 12 prevents snow accumulating along the side.

With reference to FIGS. 1 and 6, actuating device 6 comprises a control assembly 49 which, together with hydraulic circuit 37, provides for adjusting the tilt of each tool 12 about axis A2 from a remote position with respect to tiller 1, such as from the cab of the groomer vehicle not shown in the drawings.

Control assembly 49 comprises a sensor 50; a control unit 51; and a control panel 52 in turn comprising a display section 53 showing the orientation value of tools 12, and a setting section 54 for setting the orientation value of tools 12 about axis A2.

Sensor 50 is a linear position sensor for determining the position of member 19 with respect to disk 28, and the orientation of tools 12 is therefore related univocally to the position of member 19 along axis A1.

Control unit 51 acquires the signals from sensor 50 indicating the actual orientation value of tools 12, and compares the actual value with the value set on control panel 52. When the actual value differs from the set value, control unit 51 sends a correction signal to solenoid valve 44 until the actual value corresponds to the set value.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A snow grooming rotary snow tiller comprising:

a frame;

a shaft supported by said frame, said shaft configured to rotate with respect to the frame about a first axis crosswise to a direction that the frame is configured to travel along a ski slope, said shaft fitted with a plurality of tools, each tool extending along an axis for said tool which is crosswise to the first axis, each tool being selectively adjustable about the axis for said tool with respect to the first axis; and an actuating device configured to simultaneously tilt at least two of the tools about the axis for said tool with respect to the first axis.

2. The snow grooming rotary snow tiller of claim 1, wherein the actuating device includes a hydraulic circuit configured to simultaneously remote tilt the at least two tools.

3. The snow grooming rotary snow tiller of claim 1, wherein the actuating device includes a control assembly and a hydraulic circuit configured to simultaneously tilt the at least two tools from a remote position.

4. The snow grooming rotary snow tiller of claim 3, wherein the control assembly includes:

a sensor configured to determine an orientation of the tools; and a control unit which includes a control panel, said control unit configured to:

receive: (i) a plurality of signals related to the actual orientation of the tools from the sensor, and (ii) a plurality of signals related to a desired orientation of the tools from the control panel, compare the signals related to the actual orientation with the signals related to the desired orientation; and emit a correction signal to activate a solenoid valve of the hydraulic circuit when the signals related to the actual orientation differ from the signals related to the desired orientation.

5. The snow grooming rotary snow tiller of claim 1, wherein the actuating device includes:

an actuating member configured to rotate about the first axis together with a cylinder, and configured to slide along the first axis with respect to the cylinder, and a plurality of connecting connectors, each connected to the actuating member and to a different one of the tools.

6. The snow grooming rotary snow tiller of claim 5, wherein each connecting connector includes a pin that extends along the axis for the respective one of the tools and has a portion with a plurality of axial teeth configured to engage a toothed straight portion of the actuating member to rotate the pin and the respective one of the tools as a function of a translation of the actuating member.

7. The snow grooming rotary snow tiller of claim 5, wherein the actuating device includes a linear actuator connected to the actuating member and configured to rotate, together with the shaft, about the first axis.

8. The snow grooming rotary snow tiller of claim 7, wherein the linear actuator includes a double-acting hydraulic actuator.

9. The snow grooming rotary snow tiller of claim 8, which includes a rotary distributor configured to supply the linear actuator located on the shaft.

10. The snow grooming rotary snow tiller of claim 9, wherein the linear actuator includes a cylinder integral with a shaft and a piston integral with the actuating member.

11. The snow grooming rotary snow tiller of claim 1, wherein the shaft includes a cylinder including a plurality of seats, each of the tools is rotary fitted inside a respective one of the seats and each of the tools is connected to the actuating device.

12. The snow grooming rotary snow tiller of claim 1, wherein for each tool, the axis for said tool extends radially with respect to the first axis.

13. The snow grooming rotary snow tiller of claim 1, wherein each tool includes a cylindrical portion housed inside a respective seat.

14. The snow grooming rotary snow tiller of claim 1, wherein each tool includes a cutter portion.

15. The snow grooming rotary snow tiller of claim 1, wherein each of the tools is equally oriented about the axis for said tool.

16. The snow grooming rotary snow tiller of claim 1, wherein the tools are divided into at least two groups: each group includes a plurality of the tools which are equally oriented about the axis for said tool with a different orientation from that of the plurality of the tools in the other group.

17. The snow grooming rotary snow tiller of claim 14, wherein each tool is selectively tiltable to one of: a cutting position and a paddling position.

* * * * *